United States Patent [19]

Bourlier

[11] 4,170,267

[45] Oct. 9, 1979

[54] TOOTH FOR ROTARY DRILLING TOOL FOR DRILLING FOUNDATIONS

[76] Inventor: Jacques C. Bourlier, 2, rue Félix Faure, 75015 Paris, France

[21] Appl. No.: 873,971

[22] Filed: Jan. 31, 1978

[30] Foreign Application Priority Data

Feb. 3, 1977 [FR] France ..... 77 03052

[51] Int. Cl.[2] ..... E21C 35/18

[52] U.S. Cl. ..... 175/409; 299/88; 299/91; 37/142 R; 172/713

[58] Field of Search ..... 175/409, 410, 421; 299/91, 88, 24; 37/141 R, 142 R, 142 A; 172/713

[56] References Cited

U.S. PATENT DOCUMENTS

| | | | |
|---|---|---|---|
| 1,333,852 | 3/1920 | Kittredge | 37/142 R X |
| 2,088,807 | 8/1937 | Palo | 175/409 X |
| 2,940,191 | 6/1960 | Askue | 37/142 R |
| 3,286,378 | 11/1966 | Benetti | 37/142 A |
| 3,286,379 | 11/1966 | Benetti | 37/142 A |
| 3,300,883 | 1/1967 | Troeppl et al. | 175/410 X |
| 3,426,860 | 2/1969 | Petersen | 175/392 |
| 3,736,676 | 6/1973 | Sturgeon | 37/142 R |
| 3,841,709 | 10/1974 | Kniff | 37/142 R X |
| 3,888,028 | 6/1975 | White | 37/142 R |
| 4,037,337 | 7/1977 | Hemphill | 37/142 R X |

FOREIGN PATENT DOCUMENTS

| | | | |
|---|---|---|---|
| 2228901 | 12/1974 | France | 37/142 R X |
| 1252128 | 11/1971 | United Kingdom | 299/88 |

*Primary Examiner*—Ernest R. Purser
*Assistant Examiner*—Nick A. Nichols, Jr.
*Attorney, Agent, or Firm*—Cushman, Darby & Cushman

[57] ABSTRACT

A tooth for a rotary drilling tool, more particularly an earth drill especially adapted for drilling in rocky soils is described including a working or cutting portion and a retaining portion; said working portion having at least one longitudinal edge provided with a rib extending up to the cutting edge of the tooth in order to receive a tungsten carbide tip, the thickness of the web portion of said working portion of the tooth being smaller than that of said ribbed edge; said web being substantially bevelled in longitudinal section, the junction between at least one face of the retaining portion of the tooth and the working portion forming a transverse rib which defines a transverse shoulder designed to cooperate with the front side of a tooth carrier of said tool.

10 Claims, 5 Drawing Figures

TOOTH FOR ROTARY DRILLING TOOL FOR DRILLING FOUNDATIONS

BACKGROUND OF THE INVENTION

1. Field of the Invention

The present invention relates to earth drilling tools for drilling foundations and especially to teeth for drilling heads of rotary drilling tool such as earth drills or rotary buckets.

2. Description of the Prior Art

An earth drill comprises generally a tubular structure forming a shaft around which are formed flights for discharging drilled materials in the shape of an endless or Archimede screw, the lower portion of these flights forming a cutting edge, including a substantially radial drilling head and provided with a plurality of receiving members for removably receiving contoured teeth.

These receiving members, or tooth carriers, are generally provided at their front end with a recess into which the retaining base of a tooth is inserted. In a widely used embodiment, the recess in the tool carrier is formed by a longitudinal groove divided into two side portions by a transverse partition positioned centrally. The corresponding retaining bases of the teeth have thus a U shape in order to be received in the groove and to be maintained transversely therein by the partition of the tooth carrier. The tooth is introduced into the groove, said groove being provided with an elastic coating to prevent inadvertant withdrawal of the tooth.

The working portion of the tooth, or working blade, has generally a tapered longitudinal section, the edge angle and the length of the blade being adapted to the hardness of the soil to be drilled and to the rotational speed of the drilling tool.

This type of teeth presents a certain number of drawbacks when hard soils and especially rocky soils have to be drilled.

On one hand, the shape of the working portion of the tooth, or tooth blade, is not suitable for drilling rocky soils: its mechanical resistance is relatively low and its tapered section, that is its portion which is getting more slender towards the cutting area, does not permit to insert therein tungsten carbide tips which are necessary for proper drilling in such conditions. On the other hand, the retaining arrangement of the tooth base does not permit a perfectly secure retention of the tooth due to the lateral vibrations induced during drilling so that the tooth may be withdrawn inadvertantly.

Special teeth have been proposed in order to permit the insertion of tungsten carbide tips therein. In this type of teeth, the tapered portion of the blade is limited to a short chamfer at the cutting edge of the tooth, the thickness of the blade body being substantially the same as that of the tooth base. This type of tooth presents a double drawback: it does not offer a cutting profile suitable for a good penetration and it increases the overhanging weight of the blade, thus promoting tooth judder and escapement of the tooth from the tooth carrier.

BRIEF SUMMARY OF THE INVENTION

It is an object of the present invention to eliminate the drawbacks of the teeth of the prior art in providing a tooth which permits to work in rocky soils with maximum efficiency and with considerably reduced risks of teeth escapement from the tooth carrier.

It is an other object of the present invention to provide a tooth for a rotary drilling tool which has a suitable profile while permitting the insertion of tungsten carbide tips.

It is an other object of the present invention to provide such a tooth adaptable onto a conventional tooth carrier, said tooth being light in weight and having a base provided with means to ensure a proper retention into the tooth carrier.

For achieving these objects and according to a feature of the present invention, the working portion or blade of the tooth is provided with at least a thickened or ribbed longitudinal edge extending up to the cutting edge of the tooth in order to make possible the insertion of a tip made from a hard material, the thickness of the section of the web of the working portion in any transverse plane intersecting with said working portion being smaller than that of the ribbed edge, the transverse section of said web having a generally tapered shape.

According to an other feature of the present invention, a transverse shoulder is provided to extend at the junction at least between one of the plane faces of the retaining base of the tooth and the rear end of the working portion which is adjoining the retaining base.

Such a configuration of the tooth enables to provide a working blade with a suitable profile, relatively light in weight while being substantially rigid, the cutting edge transverse section having a thickness and a mechanical resistance sufficient to permit suitable insertion and durable retention of at least one tungsten carbide tip, thus permitting to increase considerably the efficiency of such a tooth when drilling in rocky soils.

On the other hand, the ribbed configuration of the working blade provides a locally increased thickness ensuring increased rigidity at the junction between the working blade and the retaining base thus permitting to form, at the end of one of the planar surfaces which define longitudinally the U-shaped retaining base, a transverse shoulder acting as a stop which cooperates with the front face of the tooth carrier, resulting in an improved contact between the tooth and the tooth carrier and reducing therefore considerably the risks of tooth escapement.

The ribbed configuration of the longitudinal edges of the working blade further permits, without reducing the mechanical resistance of the tooth, to give a curved shape to the working blade lateral profile which is of considerable interest for the outer tooth of the earth drill. It has been realized that on the outer tooth of the earth drill, due to the rotary motion of the drill, a differential wear was occuring along the cutting edge, the outermost part of the edge forming substantially a wedge relatively to the tangent to the earth drill, said part of the edge being working much more severely than the inner part of this same cutting edge, resulting after a short use in a considerable wear, this wear being occasionally such as this external wedge disappears completely.

A ribbed external edge according to the present invention has an increased mechanical resistance compared with the conventional teeth and the possibility of inserting a tungsten carbide tip provides an increased cutting efficiency and a reduced wear rate. Moreover, with such a ribbed edge, the outer edge can have substantially the shape of an arc of a circle, making thus possible to make it match more exactly the circle of rotation of the earth drill and permitting, by making the opposed ribbed edge slightly shorter, to have the cutting edge slant relatively to the soil and substantially facing the soil to be drilled during work rather than working obliquely to it as it is generally the case with the teeth having a cutting edge perpendicular to their general longitudinal direction.

It is therefore another object of the present invention to provide a tooth of the general type described hereabove, one of the ribbed edges of the working portion of which having in front view a curved profile, the convex side facing the outside of the tooth, the width of the cutting edge of the working portion being larger than the width of the retaining portion or base of the tooth, the overall length of the tooth being larger on the side of the curved ribbed edge than that on the side of the opposite ribbed edge in order to provide a slant cutting edge relatively to the general transverse direction of the tooth, that is the general radial direction of the working head.

As an alternative, to still improve the retention of the tooth in the tooth carrier, and according to another feature of the present invention, the width of the retaining base of the tooth is larger than the width of the tooth retaining jaw of the teeth carrier, at least one of the planar surfaces defining the U-shaped portion of the tooth base extending to the outer edges of the tooth base through longitudinal shoulders designed to cooperate with the lateral external surfaces of the tooth carrier.

Other objects and advantages of the present invention will become apparent from the following detailed description taken in connection with the accompanying drawings wherein are setforth by way of the illustrations and examples certain embodiments of the present invention:

DETAILED DESCRIPTION OF THE INVENTION

On these drawings and in the following description, identical elements or component parts are given the same reference numbers.

Figure 1:
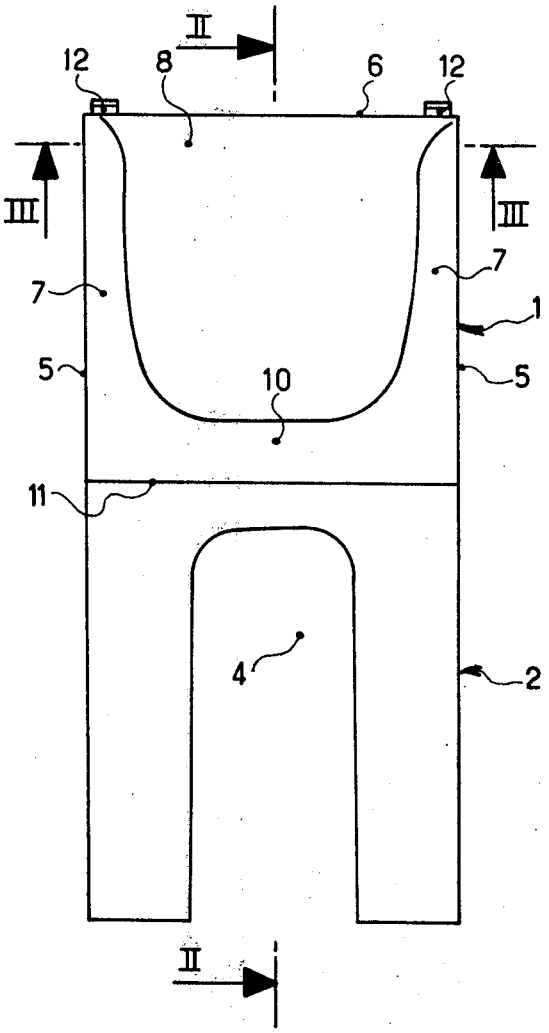
FIG. 1 is a front view of an embodiment of the tooth according to the present invention.

Referring to FIG. 1, an embodiment of the tooth of the present invention is shown, this tooth including, as is conventional, two distinct portions, one working portion or blade, indicated generally by numeral 1, and a retaining portion or base, indicated generally by numeral 2. The tooth shown on FIG. 1 has a retaining base designed to be introduced into a tooth carrier formed with grooves and a central partition, such as the device known under the tradename Pengo. This base 2 has a substantially parallelepipedic outer configuration defined particularly by longitudinal parallel planar surfaces 3 and 3' which correspond substantially to the height of the groove of the tooth carrier, a central opening 4 defining a U-shape in said base in order to cooperate with the central partition of the tooth carrier.

The working portion or blade 1 is defined laterally by two planar surfaces 5 which are an extension of the lateral faces of the base 2, and at its free end by a cutting edge 6 substantially perpendicular to the side surfaces 5. The blade 1 is provided, according to the present invention, with two thick side edges 7 which define ridges and with a central web 8 connecting these two ridges 7. As can be better seen on FIG. 3, the web 8 is relatively thin and has upper and lower substantially symmetrical web surfaces merging smoothly into the ridges 7 which form the side edges of the blade.

Figure 2:
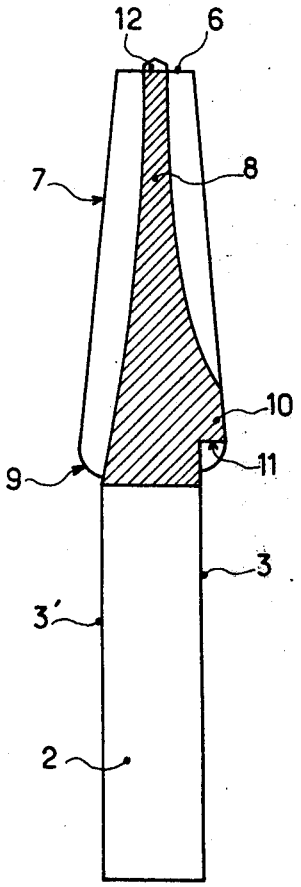
FIG. 2 is a section view taken along the line II—II of the tooth shown in FIG. 1.

As can be better seen on FIG. 2, in side view, the front and rear faces of the ribbed edges 7 are lying in planes forming a dihedron which ends into a blade Junction portion 9 substantially thicker than the tooth base 2. As can be seen on FIG. 2, the web 8 has also, in section, a generally bevelled or tapered shape tapering towards the cutting edge. The junction portion 9 of the blade is formed with a transverse rib 10 ensuring the junction between the cutting blade 1 and the tooth base 2, said transverse rib merging smoothly into the side ribs in order to enhance the rigidity and the mechanical resistance of this area of the tooth which is submitted to maximum stresses during drilling, e.g. compression stresses plus shearing stresses due to the tooth base insertion into the tooth carrier.

The junction between said transverse rib 10 and the longitudinal plane 3 of the tooth base 2 is forming a transverse shoulder 11 designed to engage with the front outer face of the tooth carrier when the tooth is inserted into the tooth carrier, thus increasing the conctact area between the tooth and the tooth carrier and limiting the possibility of lateral motion and judder of the tooth during drilling, hence reducing considerably the risks of tooth escapement from the tooth carrier.

Figure 3:
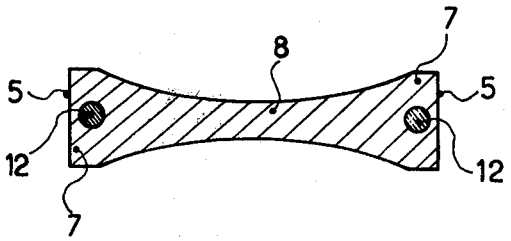
FIG. 3 is a section view taken along the line III—III of the tooth shown in FIG. 1.

As can be seen on FIGS. 2 and 3, the tooth of the present invention, while being of a slender nature and having a contour most suitable for cutting operation, presents, at its cutting edge, in the area of the ribbed edges, an enlarged section sufficient to permit the insertion according to conventional methods, of harden material tips, for example of case hardened steel or tungsten carbide, tips indicated by numeral 12, in order to improve the cutting efficiency and to reduce the wear of the teeth when drilling in rocky soils.

Figure 4:
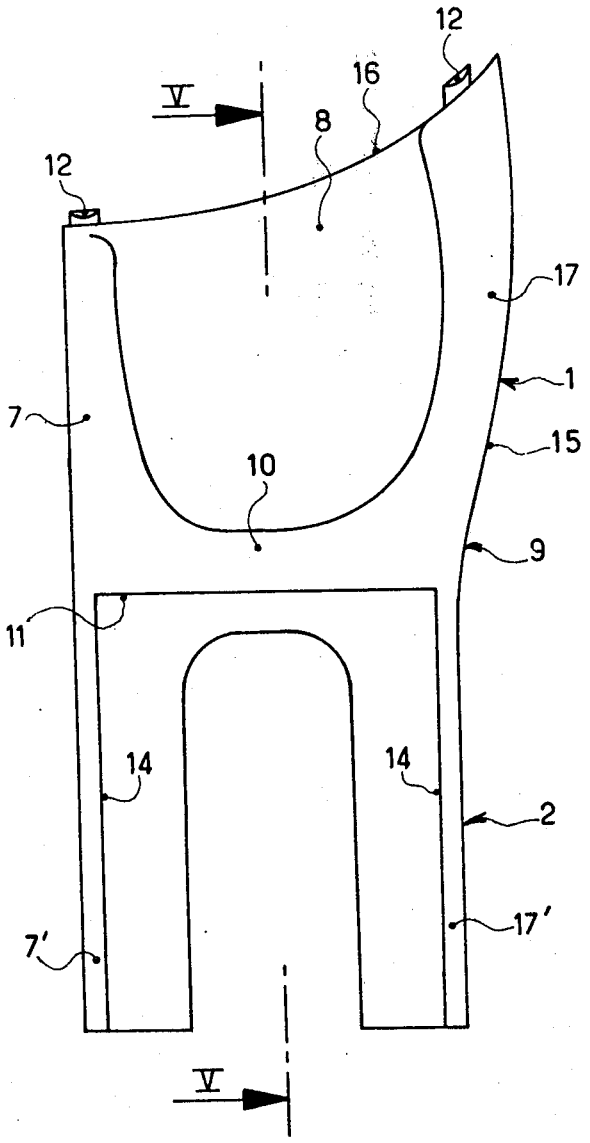
FIG. 4 is a front view of another embodiment of the tooth according to the tooth according to the present invention, especially adapted to be used as an end or outer tooth; and, FIG. 5 is a section view taken along the line V—V of the tooth shown in FIG. 4.
Figure 5:
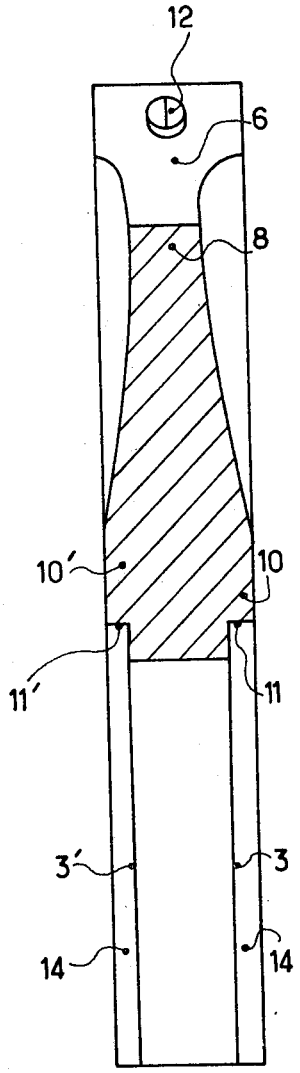

Referring to FIGS. 4 and 5, there is shown another embodiment of the tooth according to the present invention, especially adapted to be used as the end or outer tooth of a series of teeth installed on a leading edge of a rotary earth drilling tool. In providing ribs on the side edges of the tooth of the present invention, it is possible, in this embodiment, to give a curved shape to the lateral contour of the tooth which flares slightly from the junction area 9 to the cutting edge 16. The ribbed edge 17 has a curved external contour 15 the curvature of which corresponding substantially to the circular movement of the earth drill and being adapted to its radius, the width reduction of the blade 1 from the cutting edge to the base 2 permitting to disengage the tool from the rocky soils. According to a feature of the present invention, the ribbed edge 17 is longer than the opposite ribbed edge 7 in order to form a curvi-linear cutting edge 16 which is slant, especially at the cutting edge of the ribbed edge 17, relatively to the general radial direction of the cutting edge, that is the direction defined by the transverse shoulder 11, so that this slant cutting edge may be facing the soil during work rather than being positioned obliquely to the soil as it is the case generally, at least for the outer most tooth, with teeth having a rectangular blade contour of the type shown in FIGS. 1 to 3. Obviously, according to the present invention, the portion of the cutting edge defined at the front end of the curved ribbed edge 17 is provided with a tungsten carbide tip 12 similarly to the opposite ribbed edge 7 of said blade 1.

An outer tooth, as shown on FIGS. 4 and 5, being subjected to more severe conditions during work than the other teeth of the cutting of the drill is provided according to one feature of the present invention with two transverse shoulders 11 and 11' the two faces of the web 8 extending into two transverse ribs 10 and 10'. In this embodiment, as shown on FIG. 5 the overall thickness of the tooth corresponding to the thickness of the side ribbed edges is constant from the cutting edge 6 up to the end of the U-shaped tooth base, that is to say that the ribbed edges 7 and 17 extend longitudinally up to the free end of said tooth base 2. In order to permit the installation of this tooth into a tooth carrier of the type disclosed above and to further improve its retention into this tooth carrier, in addition to the transverse shoulders 11 and 11', there are provided longitudinal shoulders 14 which connect the planar surfaces 3 and 3' of said tooth base 2 with the extensions 7' and 17' of said ribbed edges 7 and 17, these shoulders being designed to cooperate with the outer side faces of the tooth carrier whereby ensuring an improved retention of the tooth in the tooth carrier.

It is to be understood that while certain forms of the invention have been illustrated and described, the invention is not to be limited to the specific forms of the invention disclosed herein.

What I claim is:

1. A tooth for a rotary drilling tool, especially for an earth tool, for use in drilling in rocky soils, said tooth including a contoured working portion defining a cutting edge and a retaining portion having a U-shaped configuration defining two planar surfaces for mounting said tooth in a tooth carrier formed with a tooth-receiving groove, a central partition and external side faces, wherein said working portion of said tooth is formed with a web having two longitudinal edges, at least one of said longitudinal edges being ribbed and extending along said working portion up to said cutting edge of said tooth, the thickness of said web of said tooth working portion being, in transverse section, smaller than that of said ribbed edge, said ribbed edge protruding in transverse cross-section on both sides of said web and having a free end of a thickness sufficient to receive a tip made from hard material, the longitudinal contour of said web being substantially bevelled.

2. A tooth for a rotary drilling tool according to claim 1, wherein said two longitudinal edges are provided with ribs, said ribs merging smoothly into a transverse rib formed in the working portion at the junction area between said working portion and said retaining portion of the tooth, the web portion opposite to said cutting edge of said tooth merging into said transverse rib.

3. A tooth for a rotary drilling tool according to claim 2, wherein the junction of said transverse rib and at least one of said planar surfaces of said U-shaped retaining portion of said tooth forms a transverse shoulder oriented towards the opening of the U.

4. A tooth for a rotary drilling tool according to claim 3, wherein said longitudinal ribs extend up to the end of said portion opposite to said cutting edge of said tooth, the width of said retaining portion being larger than that of said tooth carrier, in the groove direction of said carrier, said one planar surface which joins said transverse rib through a shoulder further joining extensions of said longitudinal ribs through longitudinal shoulders designed to cooperate with said external side faces of said tooth carrier.

5. A tooth for a rotary drilling tool according to claim 4, wherein said longitudinal ribbed edges are externally defined by planar side surfaces.

6. A tooth for a rotary drilling tool, especially for an earth drill, more particularly intended to be used as the outer tooth of a series of radially disposed teeth carriers of said tool, including a contoured working portion defining a cutting edge and a retaining portion having a U-shaped configuration defining two planar surfaces for mounting said tooth in a tooth carrier formed with a tooth receiving groove, a central partition and external side faces, wherein said working portion of said tooth is formed with a web having two longitudinal edges, at least one longitudinal edge being ribbed and extending along the working portion up to said cutting edge of the tooth and being designed to receive a tip made from hard material, the thickness of said web of said tooth working portion being, in transverse section, smaller than that of said ribbed edge, the longitudinal contour of said web being substantially bevelled, said ribbed edge having, in plan view, a curved contour, the convex side of which being oriented towards the outside of said tooth, the width of said cutting edge of said working portion being larger than that of said retaining portion, the overall length of said curved ribbed edge being larger than the length of the opposite edge whereby providing said tooth with a slant cutting edge relatively to the general transverse direction to said tooth.

7. A tooth for a rotary drilling tool, according to claim 6, wherein said cutting edge of said tooth has a curvi-linear irregular contour, the slanting angle of which relatively to said transverse direction of said tooth being larger at said curved ribbed edge.

8. A tooth for a rotary drilling tool according to claim 6, wherein said two longitudinal edges are provided with ribs, said ribs merging smoothly into a transverse rib formed in the working portion at the junction between said working portion and said retaining portion of the tooth, the web portion opposite to said cutting edge of said tooth merging into said transverse rib.

9. A tooth for a rotary drilling tool according to claim 8, wherein the junction of said transverse rib and at least one planar surface of said U-shaped retaining portion of said tooth forms a transverse shoulder oriented towards the opening of the U.

10. A tooth for a rotary drilling tool according to claim 9, wherein said longitudinal ribs extend up to the end of said portion opposite to said cutting edge of said tooth, the width of said retaining portion being larger than that of said tooth carrier, in the groove direction of said carrier, said one planar surface which joins said transverse rib through a shoulder further joining extensions of said longitudinal ribs through longitudinal shoulders designed to cooperate with said external side faces of said tooth carrier.

* * * * *